United States Patent [19]

Pennise

[11] Patent Number: 4,809,722

[45] Date of Patent: Mar. 7, 1989

[54] PAINT ROLLER CLEANER

[76] Inventor: Paul A. Pennise, 25 Butler Ave., Chalfont, Pa. 18914

[21] Appl. No.: 157,599

[22] Filed: Feb. 19, 1988

[51] Int. Cl.[4] ..... B08B 3/02

[52] U.S. Cl. ..... 134/138; 134/200; 68/213

[58] Field of Search ..... 134/138, 141, 143, 200; 68/213

[56] References Cited

U.S. PATENT DOCUMENTS

| | | | |
|---|---|---|---|
| 3,577,280 | 5/1971 | George | 134/138 |
| 3,583,413 | 6/1971 | Mertzanis | 134/200 X |
| 3,888,960 | 6/1975 | Krueger | 134/138 |
| 3,897,797 | 8/1975 | Wright et al. | 134/138 X |
| 4,641,673 | 2/1987 | Conley et al. | 134/138 |
| 4,672,987 | 6/1987 | Brandt | 134/138 |
| 4,700,728 | 10/1987 | Patterson | 134/138 |

FOREIGN PATENT DOCUMENTS

| | | | |
|---|---|---|---|
| 12002 | of 1910 | United Kingdom | 134/138 |

*Primary Examiner*—Harvey C. Hornsby
*Assistant Examiner*—Frankie L. Stinson
*Attorney, Agent, or Firm*—Joseph W. Molasky & Assocs.

[57] ABSTRACT

A paint roller cleaner is constructed of a container defining an enclosed internal chamber adapted to receive and contain a paint roller, a lid for enclosing the upper end of the container, a drain at the lower end of the container providing a liquid discharge passage, and a water supply conduit arranged to direct a stream of water into the chamber for impingment upon a roller contained therein for cleaning the same.

8 Claims, 3 Drawing Sheets

PAINT ROLLER CLEANER

BACKGROUND OF THE INVENTION

1. Field of the Invention

This invention relates to the field of cleaning devices for paint rollers of the type having a rotatable roller member and a handle.

2. Description of the Prior Art

Painters have a very difficult time in cleaning used paint rollers because the paint is absorbed s completely in the fabric of the roller cover. Not only is it difficult to remove the paint from the fabric of the roller cover, but also the present-day methods for doing so generally create a mess. Washing the roller in a bucket or the like has not been found to be satisfactory by painters. Further, while some painters resort to the technique of directing a stream of water onto the roller from a faucet or garden hose, this has also been unsatisfactory and results in a messy condition of the area where the cleaning is performed.

SUMMARY OF THE INVENTION

It is the general object of the invention to provide a paint cleaner which is capable of cleaning a paint roller effectively and without producing any mess in the area of the cleaning operation.

Briefly stated, the paint roller cleaner in accordance with the invention comprises an elongated container defining an enclosed internal chamber adapted to receive and contain the roller member of a paint roller and having a lid at one end thereof. The lid is removable from the one end of the container to permit the insertion of the roller member therein. There is provided a drain means for the container providing a passage for the discharge of liquid from the interior of the chamber. There is also provided a water supply conduit extending longitudinally along the length of the chamber and having a flow opening arranged to direct a stream of water into the chamber for impingement upon the roller member contained therein for cleaning the same. In accordance with a more specific feature of the invention, the flow opening of the water supply conduit is arranged to direct the water stream in a path offset from the axis of rotation of the roller member of the paint roller so that the impingement of the water stream on the roller member of the paint roller causes rotation thereof whereby as the roller member rotates it throws off paint therefrom.

DETAILED DESCRIPTION OF THE PREFERRED EMBODIMENTS

Figure 1:
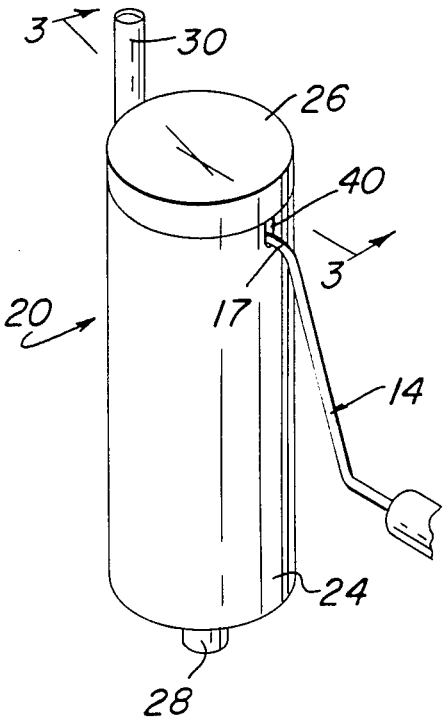
FIG. 1 is a perspective view of a paint roller cleaner in accordance with the invention.
Figure 2:
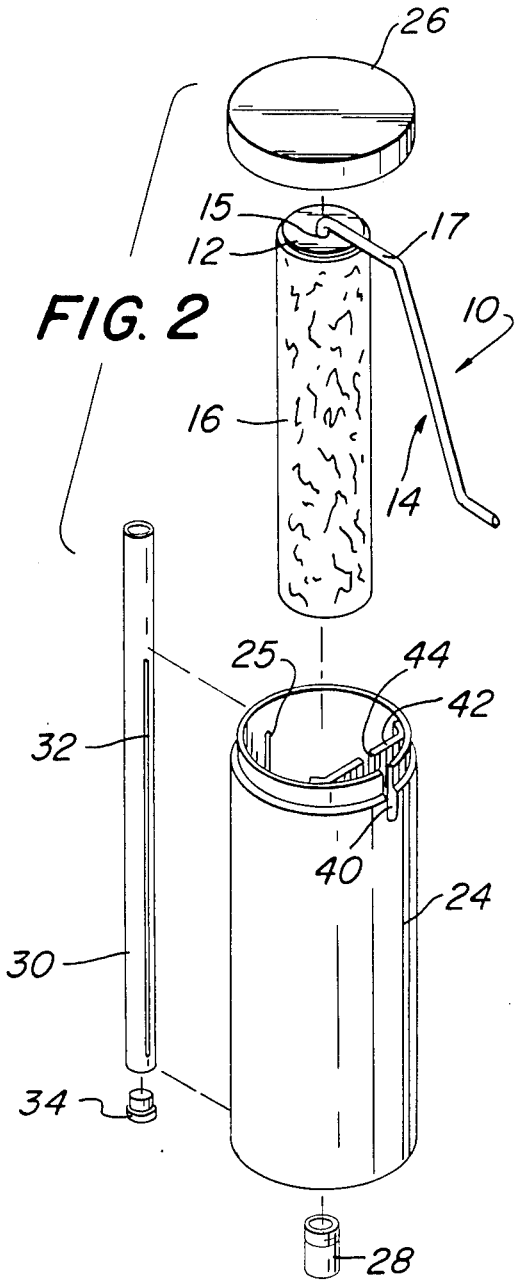
FIG. 2 is a view similar to FIG. 1 showing the various parts of the paint roller cleaner in separated condition.

In FIGS. 1–4 there is shown a paint roller cleaner in accordance with the invention for cleaning a paint roller 10 of the conventional type having a rotatable roller member 12 and a handle 14 for supporting the same. Roller member 12 is cylindrical and has a tubular fabric cover 16 enclosing its outer surface for applying the paint. As is conventional, paint roller 10 has a bearing means so that roller member 12 rotates about its longitudinal axis as it is mounted on a longitudinally extending end portion 15 of handle 14 that joins with a handle portion 17 that extends transversely to the axis of rotation of roller member 12 as is best shown in FIG. 2. Paint roller 10 is entirely conventional and is well known in the art.

Figure 3:
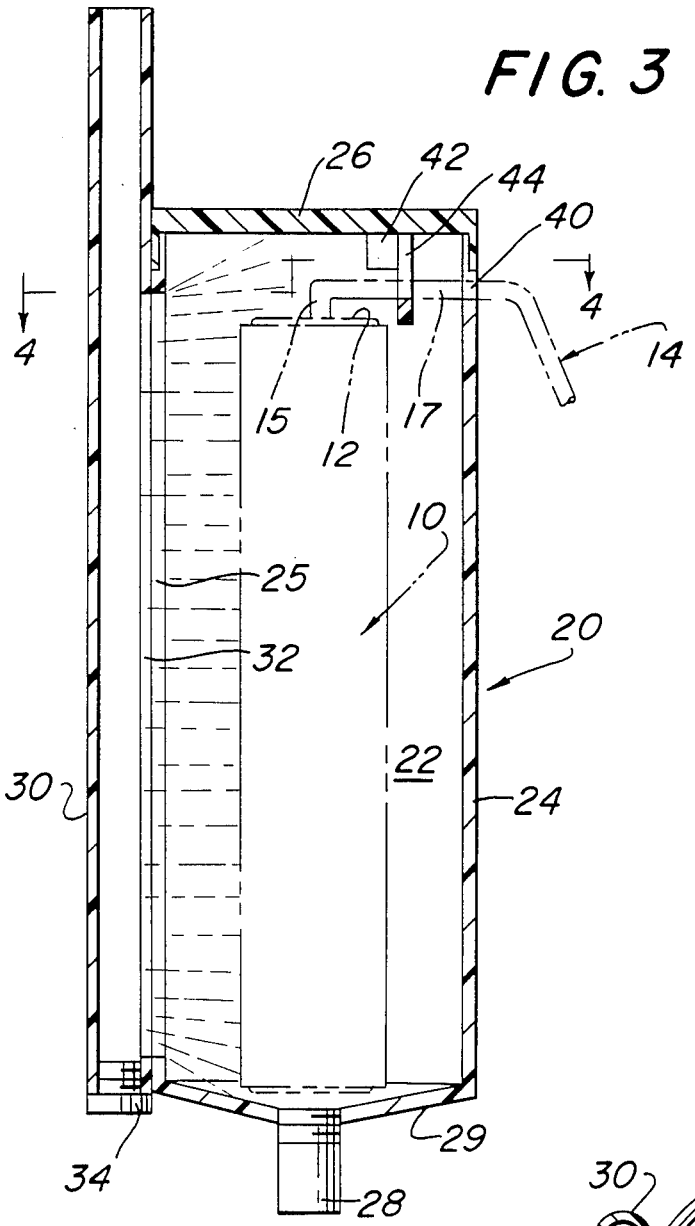
FIG. 3 is a sectional view, in elevation, of the paint roller cleaner shown in FIG. 1.

The paint roller cleaner in accordance with the invention comprises an elongated container 20 defining an enclosed internal chamber 22 adapted to receive and contain the roller member 12 of paint roller cleaner 10 as is best shown in FIG. 3. Container 20 comprises an elongated, hollow cylindrical body 24 having a lid 26 at its upper end and a drain means 28 at its lower end 29. As is best shown in FIGS. 2 and 3, lid 26 is fitted at the upper end of body 24 to be removable therefrom to permit insertion of roller member 12 therein. In the closed position of lid 26 on body 24, cooperating wall portions provide a water tight seal (see FIG. 3). Drain means 28 comprises a tube threadedly secured in the center of the lower end 29 which has a conical configuration whereby the drain means 28 provides a passage for the discharge of liquid from the interior of chamber 22 when the parts are oriented in the desired position for cleaning purposes as shown in the Drawings.

Figure 4:
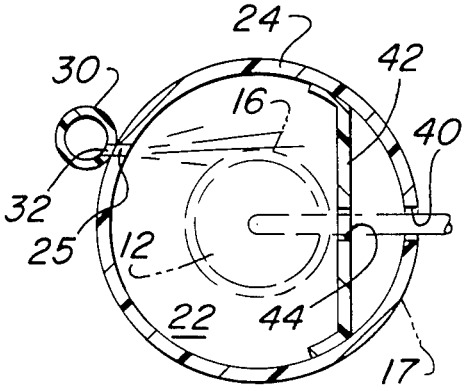
FIG. 4 is a sectional view taken on line 4—4 of FIG. 3.

A water supply conduit 30 is secured to the outer wall of body 24 to extend longitudinally along the length of chamber 22. Conduit 30 has a flow opening in the form of a longitudinally extending slot 32 aligned with a similar slot 25 in the wall of body 24. The lower end of conduit 30 is closed by a plug 34 and the upper end of conduit 30 is open to provide an inlet for the flow of water from a suitable water supply, such as a hose or the like. The parts are constructed and arranged so that the flow opening provided by slot 32 directs a stream of water through slot 25 into chamber 22 for impingement upon the roller member 12 contained therein for cleaning the fabric cover 16 which contains paint. As is best shown in FIG. 4, the flow opening of the water supply conduit 30 is arranged to direct the water stream in a path offset from the axis of rotation of roller member 12 so that the impingement of the water stream on the fabric cover 16 on the roller member 12 causes rotation thereof whereby as the roller member 12 and cover 16 rotate, paint is thrown off the cover 16 because of the centrifugal force produced. Paint is also forced from the cover 16 by the impingement of the water thereon. Any paint removed from cover 16 will flow downwardly along the wall of the body 24 of container 20 and be discharged from chamber 22 through the drain means 28 to a suitable collection device.

The paint roller cleaner in accordance with the invention is provided with means for supporting the roller member 12 of the paint roller within the internal chamber 22 so as to be spaced inwardly from the walls of body 24, the desired cleaning position being shown in FIGS. 3 and 4. To this end, there is provided a supporting means which comprises a slot 40 formed in the upper end of body 24 and providing a first supporting wall portion for receiving and supporting the transversely extending portion 17 of the handle 14 as is shown in the Drawings. The supporting means also comprises a supporting brace 42 mounted on body 24 at the upper end thereof and having a longitudinally extending slot 44 therein aligned with the slot 40 and spaced apart therefrom and providing a second supporting wall portion for the transversely extending portion 17 of the handle 14. The arrangement is such that, as is apparent from the Drawings, the paint roller cleaner 10 can be inserted into the chamber 22 by movement in a downward direction to a position in which the transversely extending portion 17 of handle 14 is received in the first and second supporting wall portions provided by the two slots 40 and 44. This arrangement serves to enable the user to accurately position the paint roller so as to be centered within the chamber 22 to a preferred position to receive the cleaning water flow as described above.

In using the paint roller cleaner shown in FIGS. 1–4, the cleaner is oriented in the position shown in the Drawings. After removing lid 26, the paint roller cleaner 10 is inserted within chamber 22 to a position with handle portion 17 received in slots 40 and 42 and the roller 12 centered within chamber 22 as shown in FIGS. 3 and 4. The lid 26 is then replaced to its water tight condition on the upper end of body 24 so that the parts are in the position as shown in FIG. 1. A water supply line, such as a hose, is then attached to the upper end of water supply conduit 30 and water under pressure is delivered into the upper end of tube 30. Water will flow downwardly through tube 30 and be discharged through the flow opening provided by slot 32 and pass through slot 25 whereby a water stream is directed in a path offset from the axis of rotation of roller member 12 to impinge upon the fabric cover on roller member 12 so as to cause rotation thereof. The paint will be removed from the roller cover 16 by the action of the water impinging thereon and by the centrifugal force produced as the roller is caused to rotate at a high speed about its axis of rotation. The paint removed from the cover 12 will flow downwardly along the wall of body 24 of container 20 and be discharged from chamber 22 through the drain means 28 to a suitable collection device provided thereunder.

Figure 5:
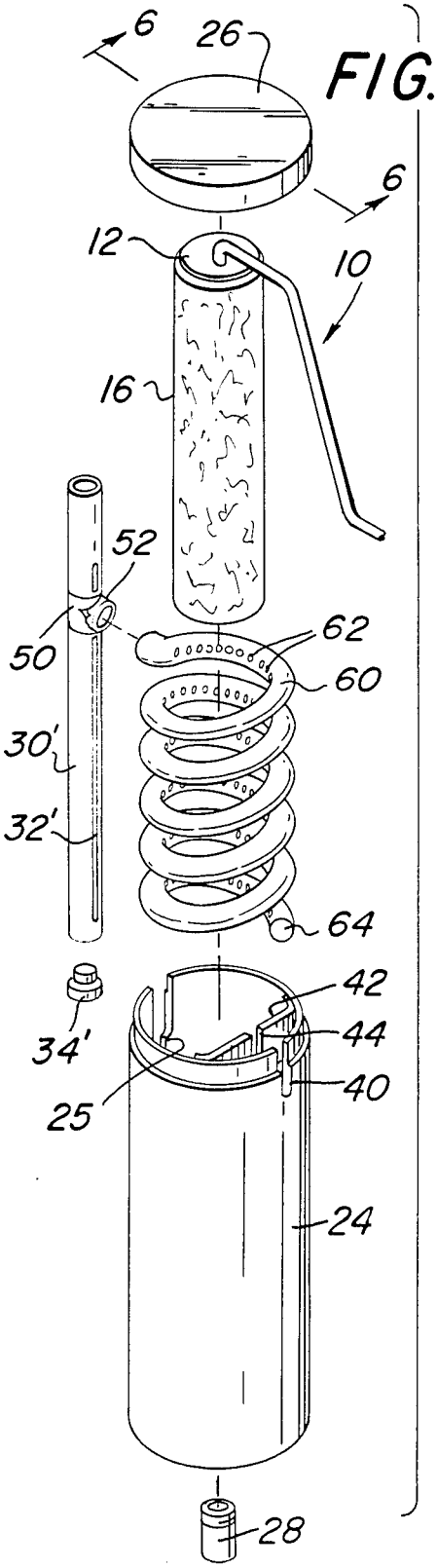
FIG. 5 is an exploded view of a second form of paint roller cleaner in accordance with the invention.
Figure 6:
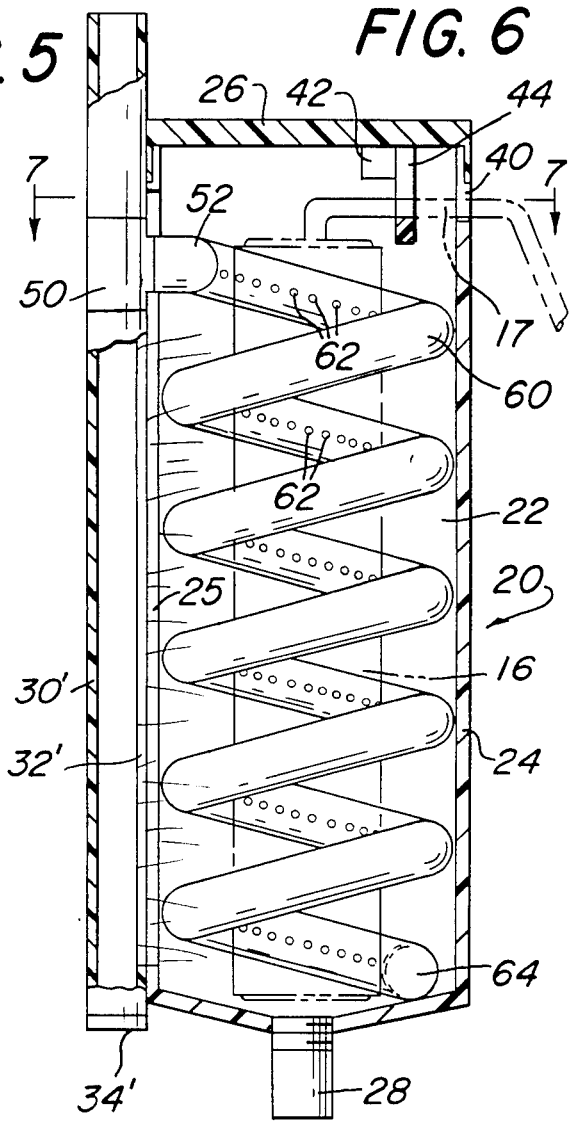
FIG. 6 is a sectional view in elevation, of the paint roller cleaner shown in FIG. 4.
Figure 7:
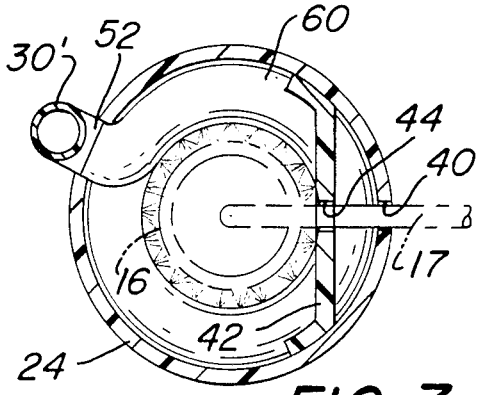
FIG. 7 is a sectional view taken on line 7—7 of FIG. 6.

In FIGS. 5–7 there is shown a second embodiment of the invention which is similar to that shown in FIGS. 1–4 except that there is provided a second water supply conduit arranged to extend in a spiral configuration around the internal wall of body 24 of container 20 and along the length thereof. The embodiment of the invention shown in FIGS. 5–7 comprises a container 20 which is the same is that shown in the embodiment of FIGS. 1–4 wherefore like reference numerals are used. The container is adapted to contain and support a paint roller 10 in the same manner as described above with respect to the FIGS. 1–4 embodiment.

The embodiment of the invention shown in FIGS. 5–7 comprises a water supply conduit 30' adapted to supply water to the second water supply conduit. To this end, water supply conduit 30' has a flow opening in the form of a longitudinally extending slot 32' aligned with a similar slot 25 in the wall of container body 24. The lower end of conduit 30' is closed by a plug 34' while the upper end of conduit 30' is open to provide an inlet for the water supply. The parts are constructed and arranged so that the flow opening provided by slot 32' directs a stream of water through slot 25 into container chamber 22 for impingement on the roller member 12 contained therein to produce a cleaning action as described above with respect to the embodiment of FIGS. 1–4. Thus, the flow opening of the water supply conduit is arranged to direct the water stream in a path offset from the axis of rotation of roller member 12 to produce the cleaning action described above.

In order to supply water to the second water supply conduit, water supply conduit 30' has a tee flow connection 50 mounted therein. Tee 50 has a leg 52 extending transversely from water supply conduit 30' into chamber 22 for connection to a second water supply conduit 60 which has a helical configuration. Water supply conduit 60 extends around the internal wall of container 20 and along the length thereof and has a plurality of discharge openings 62 therein throughout its length (FIG. 6) located to direct sprays of water inwardly towards the central portion of chamber 22 for impingement upon the roller member 12 of a paint roller 10 contained in this central portion. The second water supply conduit 60 is closed at its downstream end 64 as is best shown in FIGS. 5 and 6.

The use of the paint roller cleaner shown in FIGS. 5–7 is the same as that described above with respect to FIGS. 1–4. The only essential difference is that the use of the paint roller cleaner shown in FIGS. 5–7 involves an additional supply of water delivered from the discharge openings 62 of water supply conduit 60 directly onto the roller member 12 throughout the circumference thereof for soaking the cover 16 to aide the cleaning operation.

What is claimed is:

1. A paint roller cleaner for paint rollers having a rotatable roller member and a handle comprising:

an elongated container defining an enclosed internal chamber adapted to receive and contain the roller member of a paint roller and having a lid at one end thereof, said lid being removable from said one end of said container to permit the insertion of the roller member of a paint roller, drain means for said container providing a passage for the discharge of liquid from the interior of said chamber; and a first water supply conduit extending longitudinally along the length of said chamber and having a flow opening arranged to direct a stream of water into said chamber for impingement upon the roller member of a paint roller contained therein for cleaning the same, and a second water supply conduit extending in a spiral configuration around the internal wall of said container and along the length thereof, said second water supply conduit having a plurality of discharge openings therein located to direct sprays of water inwardly toward the central portion of said container for impingement upon the roller member of a paint roller contained in this central portion.

2. A paint roller cleaner according to claim 1 wherein said flow opening of said first water supply conduit is arranged to direct said water stream in a path offset from the axis of rotation of the roller member of the paint roller so that the impingement of said water stream on the roller member of the paint roller causes rotation thereof.

3. A paint roller cleaner according to claim 2 wherein said water stream impingement of said first water supply conduit is generally tangential to the surface of the roller member of the paint roller.

4. A paint roller cleaner according to claim 1 comprising means for supporting the roller member of a paint roller within said chamber so as to be spaced inwardly from the chamber defining portions of said container.

5. A paint roller cleaner according to claim 4 wherein said supporting means comprises a slot formed in said one end of said container and providing a first supporting wall portion for receiving and supporting the handle of a paint roller, and a supporting brace mounted on said container and having a longitudinally extending slot therein aligned with said container slot and spaced apart therefrom and providing a second supporting wall portion for the handle of a paint roller.

6. A paint roller according to claim 1 wherein said second water supply conduit has a helical configuration and is closed at the downstream end thereof.

7. A paint roller cleaner for paint rollers having a rotatable roller member and a handle comprising:

an elongated container defining an enclosed internal chamber adapted to receive and contain the roller member of a paint roller and having a lid at one end thereof, said lid being removable from said one end of said container to permit the insertion of the roller member of a paint roller, drain means for said container providing a passage for the discharge of liquid from the interior of said chamber, a first water supply conduit extending longitudinally along the length of said chamber and having a flow opening arranged to direct a stream of water into said chamber for impingement upon the roller member of a paint roller contained therein for cleaning the same, said flow opening of said first water supply conduit being arranged to direct said water stream in a path offset from the axis of rotation of the roller member of the paint roller so that the impingement of said water stream on the roller member of the paint roller causes rotation thereof, and a second water supply conduit extending in a spiral configuration around the internal wall of said container and along the length thereof, said second water supply conduit having a plurality of discharge openings therein located to direct sprays of water inwardly toward the central portion of said container for impingement upon the roller member of a paint roller contained in this central portion.

8. A paint roller according to claim 7 wherein said second water supply conduit has a helical configuration and is closed at the downstream end thereof.

* * * * *